US010446337B2

(12) United States Patent
Wu et al.

(10) Patent No.: US 10,446,337 B2
(45) Date of Patent: Oct. 15, 2019

(54) MODULARIZED STRUCTURE OF SWITCH WIRE CONNECTION DEVICE

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Chih-Kun Hsiao, New Taipei (TW); Wen-Bing Hsu, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 15/804,159

(22) Filed: Nov. 6, 2017

(65) Prior Publication Data

US 2018/0130612 A1 May 10, 2018

(30) Foreign Application Priority Data

Nov. 8, 2016 (TW) ..... 105136328 A
Jan. 18, 2017 (TW) ..... 106101620 A

(51) Int. Cl.
*H01H 13/04* (2006.01)
*H01H 1/58* (2006.01)
(Continued)

(52) U.S. Cl.
CPC ..... *H01H 1/5844* (2013.01); *H01H 13/04* (2013.01); *H01H 13/14* (2013.01);
(Continued)

(58) Field of Classification Search
CPC ..... H01H 71/02; H01H 71/0207; H01H 71/0264; H01H 13/04; H01H 13/08; H01H 13/10; H01H 13/063; H01H 19/04; H01H 21/04; H01H 2205/006; H01R 13/514; H01R 13/518; H01R 13/6658;
(Continued)

(56) References Cited

U.S. PATENT DOCUMENTS 6,717,082 B1 * 4/2004 Wu ..... H01H 13/063 200/302.2
7,064,639 B2 * 6/2006 Harvey ..... H01H 3/503 335/165

(Continued)

*Primary Examiner* — Ahmed M Saeed
(74) *Attorney, Agent, or Firm* — Rosenberg, Klein & Lee

(57) ABSTRACT

A modularized structure of switch wire connection device includes an assembling support and a wire connection module. The assembling support has a first side and a second side. The first and/or the second sides are formed with assembling sections for assembling with the wire connection module. The wire connection module includes a first wire connection module and/or a second wire connection module each having a case. The case defines a chamber for receiving and enclosing electrical contact components. The case is formed with a mounting section for connecting with the assembling section of the assembling support. The wire connection module is detachably mounted on the assembling support as an integrated form. The modularized structure enables an operator to easily assemble/disassemble the components and change the switch specification between normally open mode and normally closed mode and enhance insulation effect to avoid electric arc.

34 Claims, 4 Drawing Sheets

(51) Int. Cl.

| | |
|---|---|
| ***H01H 13/14*** | (2006.01) |
| ***H01R 4/48*** | (2006.01) |
| ***H01R 13/514*** | (2006.01) |
| ***H01R 13/518*** | (2006.01) |
| *H01H 11/00* | (2006.01) |
| *H01R 13/53* | (2006.01) |

(52) U.S. Cl.
CPC ..... *H01R 4/4827* (2013.01); *H01R 13/514* (2013.01); *H01R 13/518* (2013.01); *H01H 11/0012* (2013.01); *H01R 13/53* (2013.01)

(58) Field of Classification Search
CPC .... H01R 13/719; H01R 13/665; H01R 27/02; H01R 29/00; H01R 12/721; H01R 13/506; H01R 13/516; H01R 13/64; H01R 13/748; H01R 24/52; H01R 13/58; H01R 13/70; H01R 24/00; H01R 43/24
USPC ..... 200/51.09, 295, 16 B, 16 D, 293, 531, 200/260, 283, 51 R, 17 R, 237, 535, 200/61.53
See application file for complete search history.

(56) References Cited

U.S. PATENT DOCUMENTS 7,488,914 B2 * 2/2009 Kahnert ..... H01H 13/14 200/16 B
2014/0332357 A1 * 11/2014 Kirbawy ..... H01H 13/063 200/16 B

* cited by examiner

MODULARIZED STRUCTURE OF SWITCH WIRE CONNECTION DEVICE

BACKGROUND OF THE INVENTION

1. Field of the Invention

The present invention relates generally to a modularized structure of switch wire connection device, and more particularly to a modularized structure of switch wire connection device, which includes an assembling support and multiple modularized wire connection modules. The modularized wire connection modules are detachably mounted on the assembling support as an integrated body.

2. Description of the Related Art

A conventional switch wire connection device is a power switch device capable of connecting circuits or conductive wires. The switch wire connection device is installed on a console or distribution box of an electronic or electrical apparatus for connecting the wiring circuits. The switch wire connection device has a wire connection seat or contact seat (generally made of plastic material) and a conductive component mounted on the wire connection seat or contact seat and a screw for locking the wiring circuits or conductive wires of the electronic or electrical apparatus. By means of operating a switch pushbutton, the conductive component is controlled to electrically contact or separate from the wiring circuits or the conductive wires so as to close the circuit to power on the electronic or electrical apparatus or open the circuit to power off the electronic or electrical apparatus.

With respect to operation, use and structural design of the switch wire connection device, the switch wire connection device generally has a drum body for enclosing the above components. The contact seat and the drum body are formed with operation holes in communication with each other. An operator can use a tool to drive the screw to lock a conductive wire plugged in from lateral side. In this case, the operator necessitates a larger operation room. (Due to the limitation of the environment of the working site, the operator is often troublesome and hard to perform the operation). Moreover, the operator must bend the conductive wire to successfully lock the conductive wire. This is unbeneficial to the conductive wire.

Also, in some operation environments (such as the operation of the machine or the equipment will cause vibration), after a long term of use, the screw is apt to loosen. As a result, the conductive wire may loosen and detach from the case. Especially, when driving the screw mechanism to lock the conductive wires with the electrical contact, it is necessary to use a tool for tightening/untightening the screw. Such process is relatively troublesome.

With respect to structural design and manufacturing of the switch wire connection device, each contact seat is formed with an open cavity for arranging multiple electrical contact components therein. The multiple electrical contact components respectively form a normally open (NO) module and/or a normally closed (NC) module. At the factory manufacturing stage, the normally open (NO) module and the normally closed (NC) module have been completely manufactured according to the requirements of a user. (For example, the switch wire connection device is equipped with two normally open (NO) modules or a normally open (NO) module and a normally closed (NC) module or two normally closed (NC) modules). This means that in case of failure of the switch wire connection device, it is impossible to only replace the damaged part and it is necessary replace the entire switch wire connection device. Accordingly, the cost of the user is relatively increased.

In addition, as well known by those who are skilled in this field, due to negligence of an operator, it often takes place that the normally open (NO) module and/or the normally closed (NC) module are incorrectly arranged to fail to meet the requirement of the user.

Especially, when the switch wire connection device is applied to a conductive wire with a specification of greater current, the structure of the contact seat often causes electric arc of the adjacent conductive components. The electric arc will lead to unstable power transmission. This is not what we expect.

To speak representatively, the conventional switch wire connection device has some shortcomings in structural design and operational form. To overcome the above shortcomings, it is necessary to redesign the switch wire connection device, the contact seat and the electrical contact components to change the structure and use form of the switch wire connection device and widen the application range thereof.

For example, in the condition that it is easy to manufacture and operate the structure of the switch wire connection device, it is necessary to improve the shortcomings of the conventional switch wire connection device that the operator necessitates a larger operation room and the operator must bend the conductive wire and when driving the screw mechanism to lock the conductive wires with the electrical contact component, it is necessary to use a tool for tightening/untightening the screw and such process is relatively troublesome and harder. Also, it is necessary to further provide a modularized structure and assembling support, whereby according to the requirement, an operator or a user can detachably assemble or replace the normally open (NO) module and/or the normally closed (NC) module. This improves the shortcomings of the conventional switch wire connection device that due to negligence of an operator, it often takes place that the normally open (NO) module and/or the normally closed (NC) module are incorrectly arranged and the structure of the contact seat often causes electric arc of the adjacent conductive components. All these are not substantially taught, suggested or disclosed in the above references.

SUMMARY OF THE INVENTION

It is therefore a primary object of the present invention to provide a modularized structure of switch wire connection device includes an assembling support and a wire connection module. The assembling support has a first side and a second side. The first and/or the second sides are formed with assembling sections for assembling with the wire connection module. The wire connection module includes a first wire connection module and/or a second wire connection module each having a case. The case defines a chamber for receiving and enclosing electrical contact components including conductive members. The case is formed with a mounting section for connecting with the assembling section of the assembling support. Accordingly, the wire connection module is detachably mounted on the assembling support as an integrated form. The modularized structure enables an operator to easily assemble/disassemble the components and change the switch specification between normally open mode and normally closed mode and enhance insulation effect to avoid electric arc.

In the above modularized structure of switch wire connection device, the wire connection module includes a first wire connection module and a second wire connection module. The wire connection module (or the first and second wire connection modules) has a case. The case includes a main end wall, a mounting side and an enclosure side connected with the main end wall and a subsidiary end wall connected with the mounting side and the enclosure side. The main end wall and the mounting side are respectively formed with a main opening and a lateral opening in communication with the chamber, whereby the electrical contact components can be mounted into the chamber of the case. The first and second sides of the assembling support are respectively formed with restriction sections. The restriction sections can insert with the edge of the lateral opening of the case to help in fixing the wire connection module and the assembling support.

In the above modularized structure of switch wire connection device, the switch drum body (lower section) is formed with at least one or multiple notches. The lower section (or a section in adjacency to the subsidiary end wall) of the case (or the enclosure side) of the wire connection module is formed with an enlarged section in the position of the wire plug-in hole. The enlarged section is correspondingly assembled with the notch to enhance the assembling/fixing effect between the switch drum body and the wire connection module. In practice, the enlarged section allows the diameter of the wire plug-in hole to be enlarged, whereby a conductive wire with a larger diameter can be plugged into the wire plug-in hole.

It should be noted that in the condition that the operation room is limited, the enlarged section partially protrudes from the notch. When assembling/disassembling the switch drum body, the wire connection module and the relevant components, an operator can use a tool to securely hold the enlarged section so as to avoid unstable swing of these components.

The present invention can be best understood through the following description and accompanying drawings, wherein:

DETAILED DESCRIPTION OF THE PREFERRED EMBODIMENTS

Figure 1:
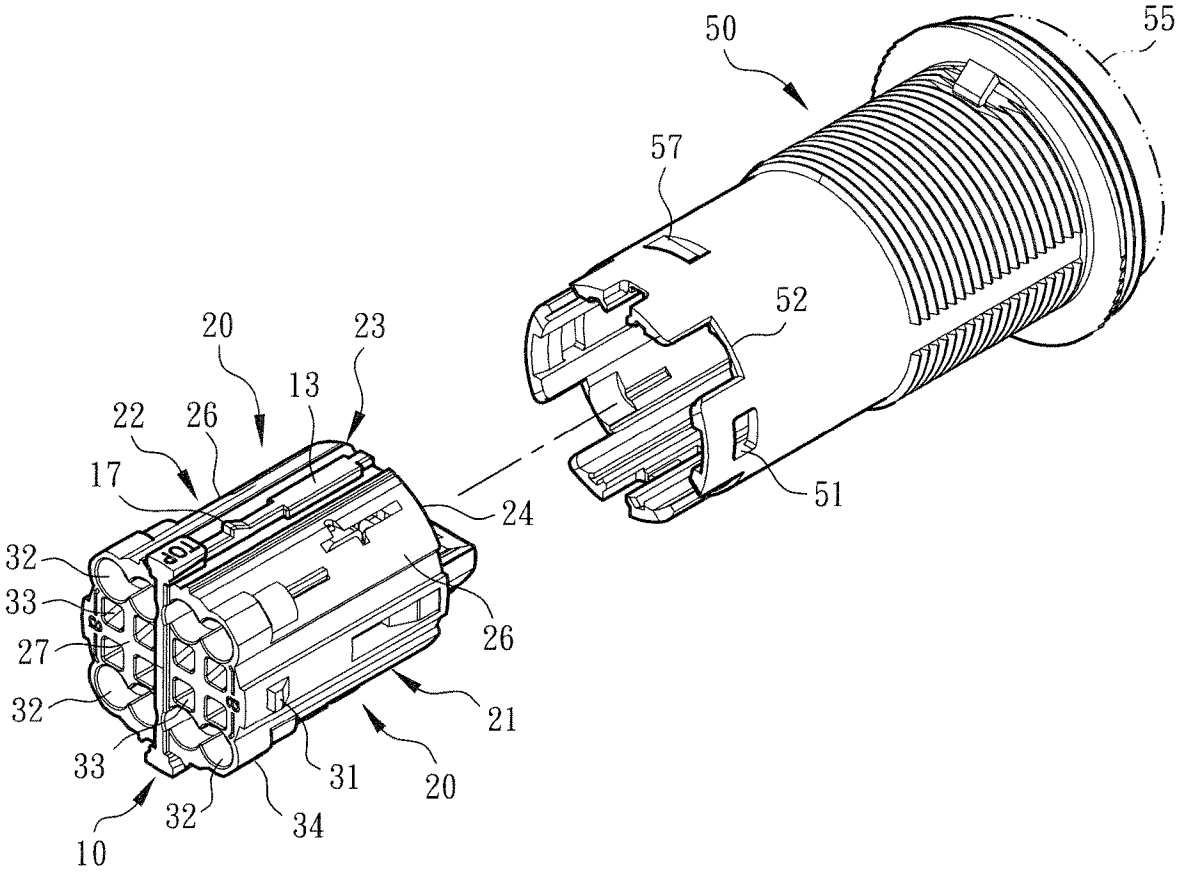
FIG. 1 is a perspective view of the present invention, showing the structures of the switch drum body, the switch pushbutton, the assembling support and the wire connection module of the present invention.
Figure 2:
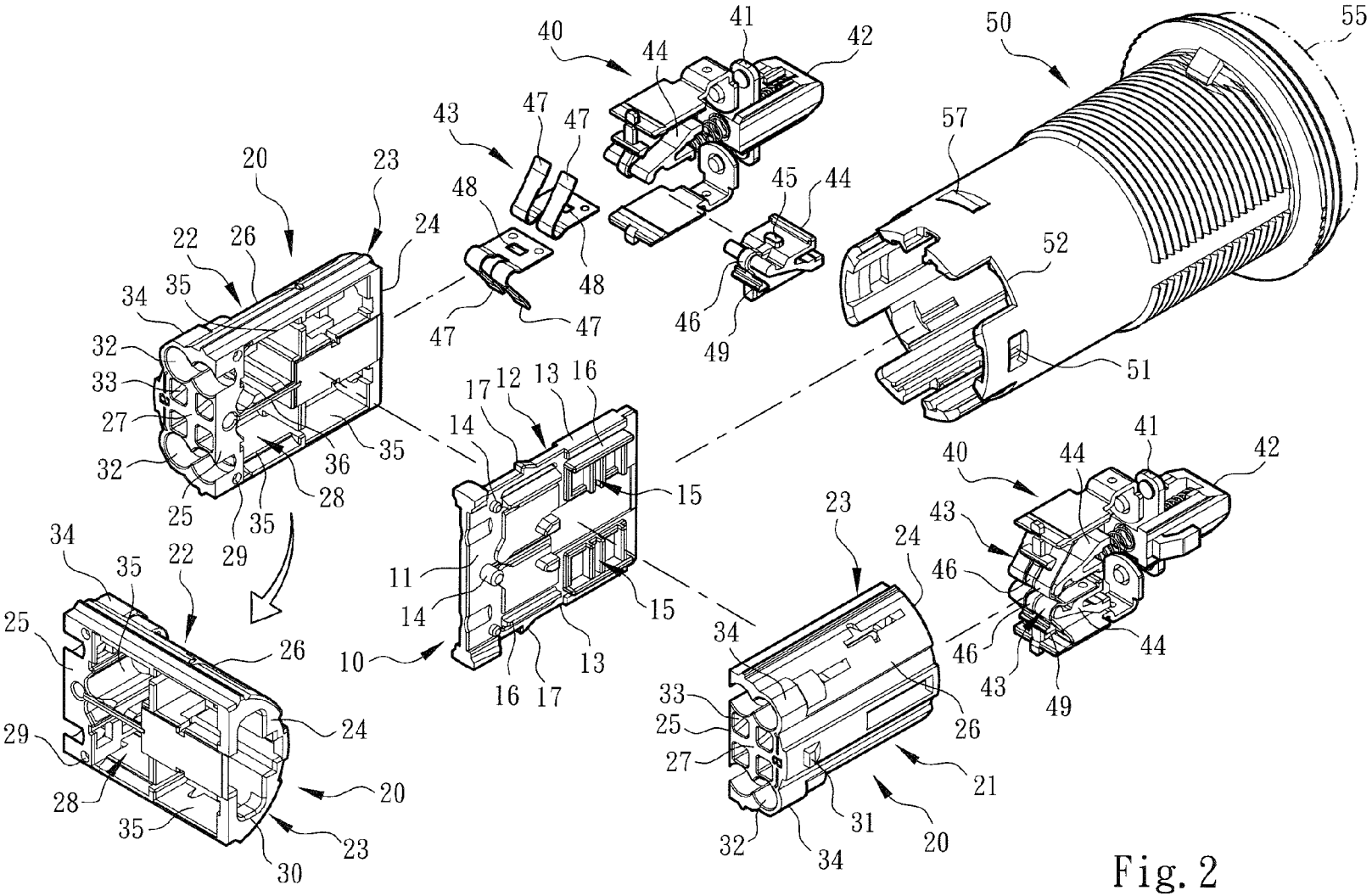
FIG. 2 is a perspective exploded view of the present invention according to FIG. 1, showing the assembly of the switch drum body, the switch pushbutton, the conductive member, the metal leaf spring, the assembling support and the wire connection module of the present invention.
Figure 3:
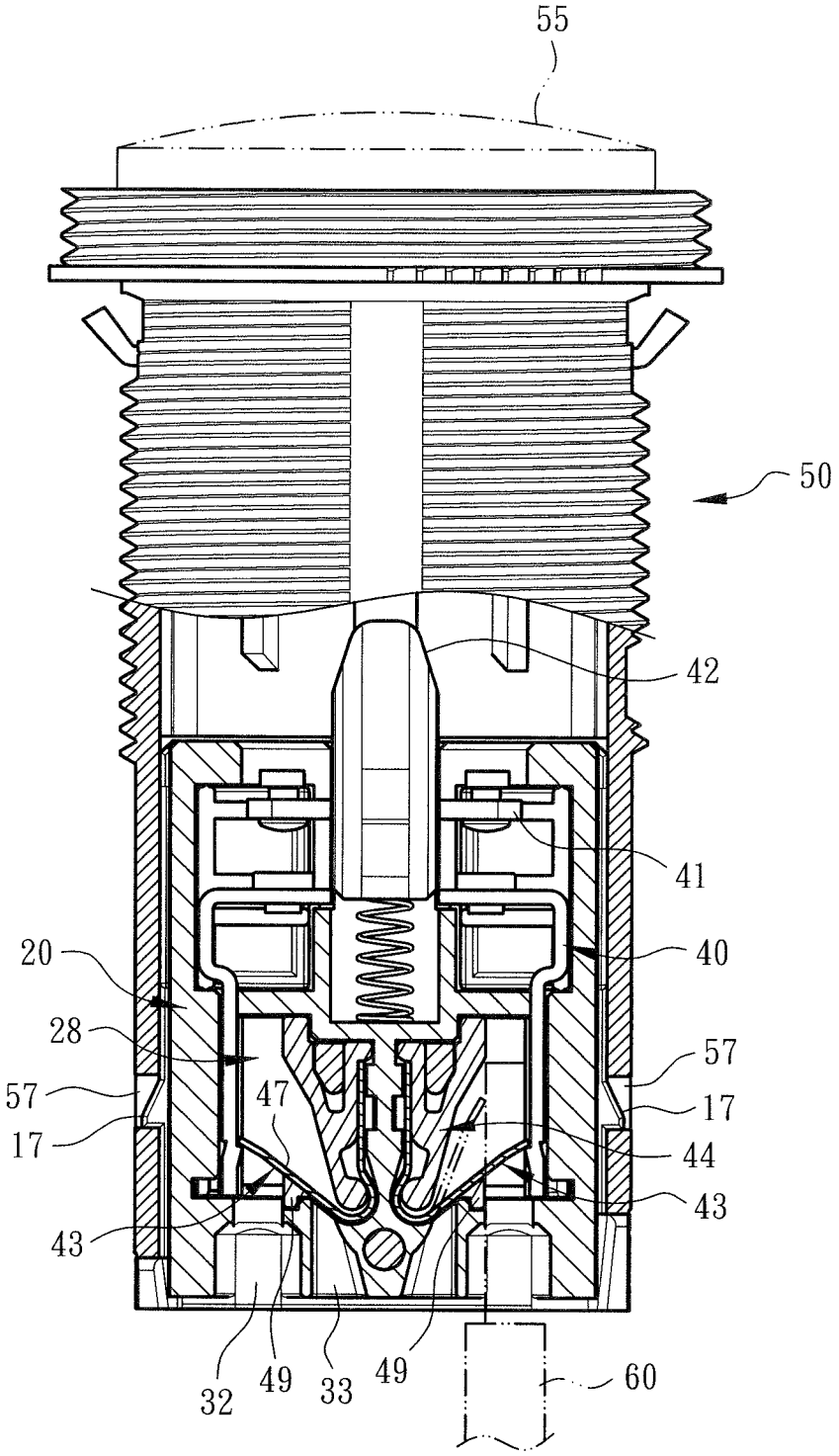
FIG. 3 is a sectional view of a preferred embodiment of the present invention, showing that the conductive wire is plugged into the wire connection module and pressed by the metal leaf spring into electrical connection with the conductive member.

Please refer to FIGS. 1, 2 and 3. The modularized structure of switch wire connection device of the present invention includes an assembling support 10. The assembling support 10 has a first side 11, a second side 12 and lateral sides 13 connected with the first and second sides 11, 12. The first and second sides 11, 12 are respectively formed with boss-shaped assembling sections 14 for assembling with a wire connection module 20.

As shown in the drawings, the wire connection module 20 includes a first wire connection module 21 and a second wire connection module 22. The wire connection module 20 (or the first and second wire connection modules 21, 22) has a case 23 with a geometrical cross section or profile. The case 23 is a semi-cylindrical structure including a main end wall 24, a mounting side 25 and an enclosure side 26 connected with the main end wall 24 and a subsidiary end wall 27 connected with the mounting side 25 and the enclosure side 26 to together define a chamber 28 for receiving and enclosing an electrical contact component 40.

In this embodiment, the mounting side 25 of the case 23 is formed with a mounting section 29 in the form of a socket for connecting with the assembling section 14 of the assembling support 10. Accordingly, the wire connection module 20 can be detachably mounted on the assembling support 10 as an integrated structure or form.

As shown in FIG. 2, the main end wall 24 and the mounting side 25 of the wire connection module 20 are respectively formed with a main opening 30 and a lateral opening 35 in communication with the chamber 28, whereby the electrical contact components 40 can be mounted into the chamber 28 of the case. The chamber 28 is formed with a diaphragm 36 positioned between the adjacent lateral openings 35 to enhance the isolation or insulation effect. In addition, the subsidiary end wall 27 is formed with a wire plug-in hole 32 and an operation hole 33 in communication with the chamber 28. The wiring circuit or conductive wire 60 (as shown in FIG. 3) of an electronic or electrical apparatus can be plugged into the chamber 28 of the case 23 through the wire plug-in hole 32. An operator can insert a tool into the wire connection module 20 through the operation hole 33 to release the conductive wire 60 from the electrical connection of the electrical contact components 40 as shown in FIG. 3.

In a preferred embodiment, the first and second sides 11, 12 of the assembling support 10 are respectively formed with locating section 15 and restriction section 16 in the form of board body or rib body. The locating section 15 helps the wire connection module 20 or the case 23 to fix the electrical contact components 40. The restriction section 16 can insert with the edge of the lateral opening 35 of the case to help in fixing the wire connection module 20 and the assembling support 10.

It should be noted that the electrical contact component 40 includes a conductive member 41, a control member 42 for making the electrical contact component 40 (or the conductive member 41) form a normally open (NO) or open-circuit module and/or a normally closed (NC) or closed-circuit module, and a metal leaf spring 43 for elastically pressing the conductive wire 60. The electrical contact component 40 has a fixing body 44 formed with a locating section 45 and a separation section 46 for mounting and fixing the metal leaf spring 43. The separation section 46 is positioned between the two spaced end legs 47 of the metal leaf spring 43. In addition, the locating section 45 is securely assembled with the locating section 48 formed on the metal leaf spring 43 in the form of a hole structure. The fixing body 44 is formed with a bearing section 49 for bearing (or previously slightly pressing) the two spaced end legs 47 of the metal leaf spring 43, whereby the two end legs 47 can respectively elastically press multiple plugged in conductive wires 60.

The assembling support 10, the wire connection module 20 and the electrical contact components 40 are together mounted in a switch drum body 50. The switch drum body 50 is equipped with a switch pushbutton 55 for an operator to operate and drive the control member 42 to control the electrical contact components 40 into a turn-on state or a turn-off state. (This pertains to prior art and thus will not be further described hereinafter).

In this embodiment, according to the use requirement, an operator can securely assemble the wire connection module 20 (or the first and second wire connection modules 21, 22) with the first side 11 and/or second side 12 of the assembling support 10 by means of the mounting section 29 and the assembling section 14. In addition, the lateral side 13 of the assembling support 10 is formed with a protruding insertion section 17. The enclosure side 26 of the wire connection module 20 is also formed with a protruding insertion section 31. When the assembling support 10 and the wire connection module 20 are together mounted into the switch drum body 50, the insertion sections 17, 31 will respectively securely insert on the insertion sections 57, 51 formed on the switch drum body 50. As shown in the drawings, the insertion sections 57, 51 are in the form of a hole.

It should be noted that an operator can assemble the first wire connection modules 21 into a batch of normally open (NO) modules and/or assemble the second wire connection modules 22 into a batch of normally closed (NC) modules. Then, according to the use requirement, the operator can selectively assemble the first wire connection module 21 and/or the second wire connection module 22 with the first side 11 and/or the second side 12 of the assembling support 10. For example, at least one or two normally open (NO) modules are mounted on the assembling support 10. Alternatively, a normally open (NO) module and a normally closed (NC) module are mounted on the assembling support 10. Still alternatively, at least one or two normally closed (NC) modules are mounted on the assembling support 10.

The first wire connection modules 21 and the second wire connection modules 22 are respectively classified into two batches of products. This helps in reducing the error of the operator in assembling process. Moreover, the first and second wire connection modules 21, 22 are separately assembled with the assembling support 10. This helps in enhancing the insulation effect of the switch wire connection device and avoids electric arc of the first and second wire connection modules 21, 22 to prevent the first and second wire connection modules 21, 22 from interfering with each other.

Figure 5:
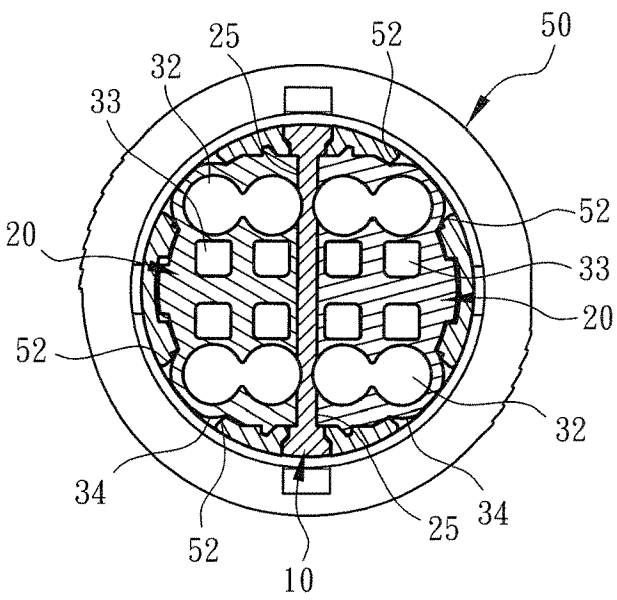
FIG. 5 is a plane sectional view of the present invention, showing the assembly of the switch drum body, the assembling support and the wire connection module of the present invention.
Figure 4:
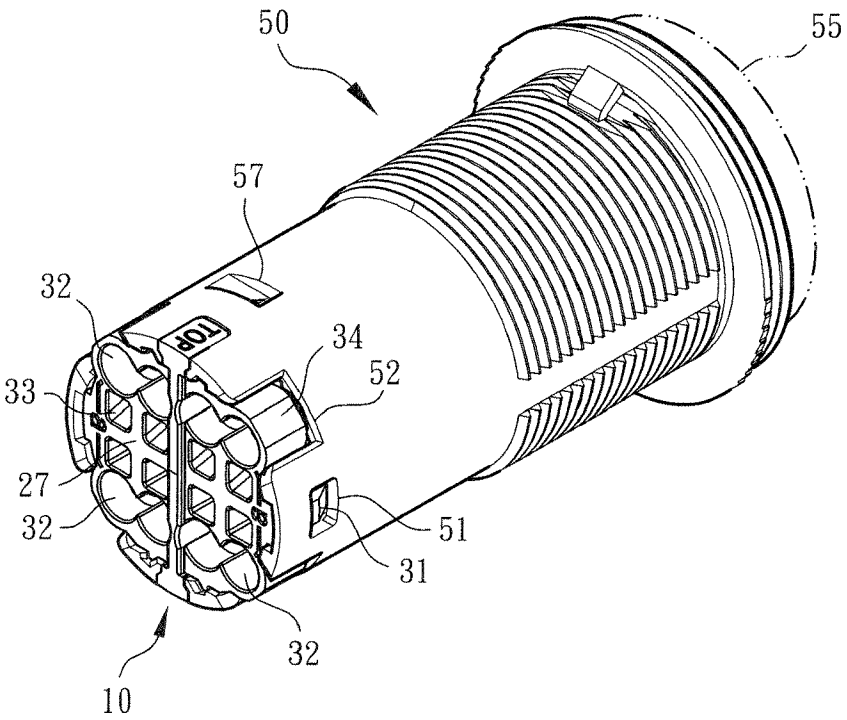
FIG. 4 is a perspective assembled view of the present invention according to FIG. 1, showing the cooperative structures of the switch drum body, the assembling support and the wire connection module of the present invention.

Please now refer to FIGS. 4 and 5. In this embodiment, the switch drum body 50 (lower section) is formed with at least one or multiple notches 52. The lower section (or a section in adjacency to the subsidiary end wall 27) of the case 23 (or the enclosure side 26) of the wire connection module 20 is formed with an enlarged section 34 in the position of the wire plug-in hole 32. The enlarged section 34 is correspondingly assembled with the notch 52 to enhance the assembling/fixing effect between the switch drum body 50 and the wire connection module 20. In practice, the enlarged section 34 allows the diameter of the wire plug-in hole 32 to be enlarged, whereby a conductive wire 60 with a larger diameter can be plugged into the wire plug-in hole 32.

It should be noted that in the condition that the operation room is limited, the enlarged section 34 partially protrudes from the notch 52. When assembling/disassembling the switch drum body 50, the wire connection module 20 and the relevant components, an operator can use a tool to securely hold the enlarged section 34 so as to avoid unstable swing of these components.

To speak representatively, in the condition that the operation is facilitated, in comparison with the conventional switch wire connection device, the modularized structure of switch wire connection device of the present invention has the following advantages:

1. The switch wire connection device, the contact seat and the relevant components and structures have been redesigned in use and operation form to be obviously different from the conventional switch wire connection device. For example, the assembling support 10 has a first side 11 and a second side 12. The first and second sides 11, 12 are respectively formed with the assembling sections 14 and/or restriction sections 16. The wire connection module 20 (or the first and second wire connection modules 21, 22) has a case 23 with a geometrical cross section. The case 23 has a main end wall 24 and a mounting side 25 respectively formed with a main opening 30 and a lateral opening 35 for mounting the electrical contact components 40. The mounting side 25 is formed with a mounting sect ion 29, whereby the wire connection module 20 can be detachably mounted on the assembling support 10 to form different specification or the normally open (NO) modules and/or the normally closed (NC) modules.
2. Especially, in the conventional switch wire connection device, the assembling/disassembling of the wiring circuit or the conductive wire necessitates a larger operation room and it is necessary to bend the conductive wire to successfully operate the screw to lock the electrical contact components. This is relatively troublesome and harder and unbeneficial to the conductive wire. The present invention obviously improves the shortcomings of the conventional switch wire connection device. In addition, the assembling support 10 and the first and second wire connection modules 21, 22 are formed with modularized structures. Therefore, according to the requirement, an operator or a user can detachably assemble or replace the normally open (NO) module and/or the normally closed (NC) module. During the use of the switch wire connection device, this permits the operator to only replace the failing component to lower the cost of the user. In addition, this improves the shortcoming of the conventional switch wire connection device that it often takes place that the operator incorrectly assembles the components to cause electric arc of the adjacent electrical contact components.

In conclusion, the modularized structure of switch wire connection device of the present invention is effective and different from the conventional switch wire connection device in space form. The modularized structure of switch wire connection device of the present invention is inventive, greatly advanced and advantageous over the conventional switch device.

The above embodiments are only used to illustrate the present invention, not intended to limit the scope thereof. Many modifications of the above embodiments can be made without departing from the spirit of the present invention.

What is claimed is:

1. A modularized structure of switch wire connection device comprising a switch drum body defining a longitudinally extended space and an assembly of an assembling support and a wire connection module, the assembling support having a first side, a second side and lateral sides connected with the first and second sides, at least one of the first and second sides being formed with an assembling section for assembling with the wire connection module, the wire connection module having a case with a geometrical cross section, the case including a main end wall, a mounting side and an enclosure side connected with the main end wall and a subsidiary end wall connected with the mounting side and the enclosure side to together define a chamber, the mounting side of the case being formed with a mounting section for connecting with the assembling section of the assembling support, whereby the wire connection module is detachably mounted on the assembling support as an integrated form, the assembly of the assembling support and wire connection module being received in the longitudinally extended space of the switch drum body.

2. The modularized structure of switch wire connection device as claimed in claim 1, wherein the chamber of the wire connection module serves to receive and enclose an electrical contact component, the electrical contact component including a conductive member, a control member for making the conductive member form a normally open module and a normally closed module, and a metal leaf spring for elastically pressing the conductive wire, the assembling support, the wire connection module and the electrical contact component being together mounted in the switch drum body, the switch drum body being equipped with a switch pushbutton for driving the control member.

3. The modularized structure of switch wire connection device as claimed in claim 1, wherein the mounting section of the case is in the form of a socket structure and the assembling section of the assembling support is in the form of a boss-shaped structure.

4. The modularized structure of switch wire connection device as claimed in claim 2, wherein the mounting section of the case is in the form of a socket structure and the assembling section of the assembling support is in the form of a boss-shaped structure.

5. The modularized structure of switch wire connection device as claimed in claim 1, wherein at least one of the first and second sides of the assembling support is formed with a locating section and a restriction section.

6. The modularized structure of switch wire connection device as claimed in claim 5, wherein the locating section and the restriction section are in the form of board body or rib body.

7. The modularized structure of switch wire connection device as claimed in claim 2, wherein the lateral side of the assembling support is formed with a protruding insertion section and the enclosure side of the wire connection module is also formed with a protruding insertion section, the switch drum body being formed with insertion sections in the form of a hole for correspondingly assembling with the insertion section of the assembling support and the insertion section of the wire connection module.

8. The modularized structure of switch wire connection device as claimed in claim 1, wherein the assembling support and the wire connection module are together mounted in the switch drum body, the switch drum body being formed with at least one notch, the case of the wire connection module having a wire plug-in hole and an enlarged section formed in the position of the wire plug-in hole, the enlarged section being correspondingly assembled with the notch.

9. The modularized structure of switch wire connection device as claimed in claim 2, wherein the switch drum body is formed with at least one notch, the case of the wire connection module having a wire plug-in hole and an enlarged section formed in the position of the wire plug-in hole, the enlarged section being correspondingly assembled with the notch.

10. The modularized structure of switch wire connection device as claimed in claim 5, wherein the assembling support and the wire connection module are together mounted in the switch drum body, the switch drum body being formed with at least one notch, a lower section of the case of the wire connection module having a wire plug-in hole and an enlarged section formed in the position of the wire plug-in hole, the enlarged section being correspondingly assembled with the notch.

11. The modularized structure of switch wire connection device as claimed in claim 7, wherein the switch drum body is formed with at least one notch, the lower section of the case of the wire connection module being formed with an enlarged section, the enlarged section being correspondingly assembled with the notch.

12. A modularized structure of switch wire connection device comprising an assembly of an assembling support and a wire connection module, the assembling support having a first side, a second side and lateral sides connected with the first and second sides, at least one of the first and second sides being formed with an assembling section for assembling with the wire connection module, the wire connection module having a case with a geometrical cross section, the case including a main end wall, a mounting side and an enclosure side connected with the main end wall and a subsidiary end wall connected with the mounting side and the enclosure side to together define a chamber, the mounting side of the case being formed with a mounting section for connecting with the assembling section of the assembling support, whereby the wire connection module is detachably mounted on the assembling support as an integrated form;

wherein the first and second sides of the assembling support are respectively formed with boss-shaped assembling sections, the wire connection module including a first wire connection module and a second wire connection module, the first wire connection module being mounted on the first side, while the second wire connection module being mounted on the second side, the case of the wire connection module being a semi-cylindrical structure, the main end wall and the mounting side being respectively formed with a main opening and a lateral opening in communication with the chamber, the chamber being formed with a diaphragm positioned adjacent the lateral opening, the subsidiary end wall being formed with a wire plug-in hole and an operation hole in communication with the chamber.

13. The modularized structure of switch wire connection device as claimed in claim 12, wherein the chamber of the wire connection module serves to receive and enclose an electrical contact component, the electrical contact component including a conductive member, a control member for making the conductive member form a normally open module and a normally closed module, and a metal leaf spring for elastically pressing the conductive wire, the assembling support, the wire connection module and the electrical contact component being together mounted in a switch drum body, the switch drum body being equipped with a switch pushbutton for driving the control member, the electrical contact component of the first wire connection module forming one of the normally open module and the normally closed module, the electrical contact component of the second wire connection module forming one of the normally open module and the normally closed module.

14. The modularized structure of switch wire connection device as claimed in claim 12, wherein the mounting section of the case is in the form of a socket structure and the assembling section of the assembling support is in the form of a boss-shaped structure.

15. The modularized structure of switch wire connection device as claimed in claim 13, wherein the mounting section of the case is in the form of a socket structure and the assembling section of the assembling support is in the form of a boss-shaped structure.

16. The modularized structure of switch wire connection device as claimed in claim 12, wherein the first and second sides of the assembling support are respectively formed with a locating section and a restriction section.

17. The modularized structure of switch wire connection device as claimed in claim 13, wherein the first and second sides of the assembling support are respectively formed with a locating section and a restriction section, the locating section helping the case to fix the electrical contact component, the restriction section being inserted with an edge of the lateral opening of the case to help in fixing the wire connection module, the electrical contact component having a fixing body formed with a locating section and a separation section, the separation section being positioned between two spaced end legs of the metal leaf spring, the locating section being securely assembled with a locating section formed on the metal leaf spring in the form of a hole structure, the fixing body being formed with a bearing section for bearing the two spaced end legs of the metal leaf spring.

18. The modularized structure of switch wire connection device as claimed in claim 16, wherein the locating section and the restriction section are in the form of board body or rib body.

19. The modularized structure of switch wire connection device as claimed in claim 17, wherein the locating section and the restriction section are in the form of board body or rib body.

20. The modularized structure of switch wire connection device as claimed in claim 13, wherein the lateral side of the assembling support is formed with a protruding insertion section and the enclosure side of the wire connection module is also formed with a protruding insertion section, the switch drum body being formed with insertion sections in the form of a hole for correspondingly assembling with the insertion section of the assembling support and the insertion section of the wire connection module.

21. The modularized structure of switch wire connection device as claimed in claim 17, wherein the lateral side of the assembling support is formed with a protruding insertion section and the enclosure side of the wire connection module is also formed with a protruding insertion section, the switch drum body being formed with insertion sections in the form of a hole for correspondingly assembling with the insertion section of the assembling support and the insertion section of the wire connection module.

22. The modularized structure of switch wire connection device as claimed in claim 19, wherein the lateral side of the assembling support is formed with a protruding insertion section and the enclosure side of the wire connection module is also formed with a protruding insertion section, the switch drum body being formed with insertion sections in the form of a hole for correspondingly assembling with the insertion section of the assembling support and the insertion section of the wire connection module.

23. The modularized structure of switch wire connection device as claimed in claim 12, wherein the assembling support and the wire connection module are together mounted in a switch drum body, the switch drum body being formed with at least one notch, the case of the wire connection module being formed with an enlarged section in the position of the wire plug-in hole, the enlarged section being correspondingly assembled with the notch.

24. The modularized structure of switch wire connection device as claimed in claim 13, wherein the switch drum body is formed with at least one notch, the case of the wire connection module being formed with an enlarged section in the position of the wire plug-in hole, the enlarged section being correspondingly assembled with the notch.

25. The modularized structure of switch wire connection device as claimed in claim 16, wherein the assembling support and the wire connection module are together mounted in a switch drum body, the switch drum body being formed with at least one notch, a lower section of the case of the wire connection module being formed with an enlarged section in the position of the wire plug-in hole, the enlarged section being correspondingly assembled with the notch.

26. The modularized structure of switch wire connection device as claimed in claim 17, wherein the switch drum body is formed with at least one notch, the case of the wire connection module being formed with an enlarged section in the position of the wire plug-in hole, the enlarged section being correspondingly assembled with the notch.

27. The modularized structure of switch wire connection device as claimed in claim 20, wherein the switch drum body is formed with at least one notch, the lower section of the case of the wire connection module being formed with an enlarged section, the enlarged section being correspondingly assembled with the notch.

28. The modularized structure of switch wire connection device as claimed in claim 21, wherein the switch drum body is formed with at least one notch, the lower section of the case of the wire connection module being formed with an enlarged section, the enlarged section being correspondingly assembled with the notch.

29. A modularized structure of switch wire connection device comprising an assembly of an assembling support and a wire connection module, the assembling support having a first side, a second side and lateral sides connected with the first and second sides, at least one of the first and second sides being formed with an assembling section for assembling with the wire connection module, the wire connection module having a case with a geometrical cross section, the case including a main end wall, a mounting side and an enclosure side connected with the main end wall and a subsidiary end wall connected with the mounting side and the enclosure side to together define a chamber, the mounting side of the case being formed with a mounting section for connecting with the assembling section of the assembling support, whereby the wire connection module is detachably mounted on the assembling support as an integrated form;

wherein the chamber of the wire connection module serves to receive and enclose an electrical contact component, the electrical contact component including a conductive member, a control member for making the conductive member form a normally open module and a normally closed module, and a metal leaf spring for elastically pressing the conductive wire, the assembling support, the wire connection module and the electrical contact component being together mounted in a switch drum body, the switch drum body being equipped with a switch pushbutton for driving the control member;

wherein at least one of the first and second sides of the assembling support is formed with a locating section and a restriction section, the locating section helping the case to fix the electrical contact component, the electrical contact component having a fixing body formed with a locating section and a separation section, the separation section being positioned between two spaced end legs of the metal leaf spring, the locating section being securely assembled with a locating section formed on the metal leaf spring in the form of a hole structure, the fixing body being formed with a bearing section for bearing the two spaced end legs of the metal leaf spring.

30. The modularized structure of switch wire connection device as claimed in claim 29, wherein the locating section and the restriction section are in the form of board body or rib body.

31. The modularized structure of switch wire connection device as claimed in claim 29, wherein the lateral side of the assembling support is formed with a protruding insertion section and the enclosure side of the wire connection module is also formed with a protruding insertion section, the switch drum body being formed with insertion sections in the form of a hole for correspondingly assembling with the insertion section of the assembling support and the insertion section of the wire connection module.

32. The modularized structure of switch wire connection device as claimed in claim 30, wherein the lateral side of the assembling support is formed with a protruding insertion section and the enclosure side of the wire connection module is also formed with a protruding insertion section, the switch drum body being formed with insertion sections in the form of a hole for correspondingly assembling with the insertion section of the assembling support and the insertion section of the wire connection module.

33. The modularized structure of switch wire connection device as claimed in claim 29, wherein the switch drum body is formed with at least one notch, the case of the wire connection module having a wire plug-in hole and an enlarged section formed in the position of the wire plug-in hole, the enlarged section being correspondingly assembled with the notch.

34. The modularized structure of switch wire connection device as claimed in claim 31, wherein the switch drum body is formed with at least one notch, the lower section of the case of the wire connection module being formed with an enlarged section, the enlarged section being correspondingly assembled with the notch.

* * * * *